US005337523A

United States Patent [19]

Walsh

[11] Patent Number: 5,337,523

[45] Date of Patent: Aug. 16, 1994

[54] UTILITY TOOL

[76] Inventor: David C. Walsh, 200 Custom Pl., Bogart, Ga. 30622

[21] Appl. No.: 983,435

[22] Filed: Dec. 2, 1992

[51] Int. Cl.[5] ..... B24D 15/04

[52] U.S. Cl. ..... 51/370; 51/392; 15/245

[58] Field of Search ..... 51/370, 371, 369, 375, 51/389, 358, 391–393, 205 R, 214; 15/245

[56] References Cited

U.S. PATENT DOCUMENTS

| | | | |
|---|---|---|---|
| 224,970 | 2/1880 | Teter | 51/205 R |
| 701,278 | 6/1902 | Adcock | 15/244.1 |
| 838,465 | 12/1906 | Seaborn | 51/383 |
| 2,033,134 | 3/1936 | Fancher | 51/393 |
| 2,103,320 | 12/1937 | Corff | 51/371 |
| 2,220,727 | 11/1940 | Nordlund | 51/371 |
| 2,515,469 | 7/1950 | Power | 51/389 |
| 2,922,177 | 1/1960 | Hudson | 401/207 |
| 3,034,267 | 5/1962 | Feeney | 51/360 |
| 3,842,549 | 10/1974 | Johnston | 51/392 |
| 4,391,014 | 7/1983 | Pitzen | 51/391 |
| 5,131,193 | 7/1992 | Demers | 51/391 |

*Primary Examiner*—Robert A. Rose
*Attorney, Agent, or Firm*—Jones & Askew

[57] ABSTRACT

A hand-held sander having inserts that interchangeably fit a holder. The inserts have an exterior surface for supporting sandpaper or the like, and that surface is contoured to match a particular surface detail of a vehicle body or other workpiece. The holder includes a shell having a somewhat U-shaped cross-section defining a slot along one edge, and the insert has a spline that slides within the slot when removing or installing the insert. Either or both ends of that slot are selectively enlarged by means of a cam attached to an end member of the holder.

21 Claims, 7 Drawing Sheets

UTILITY TOOL

FIELD OF THE INVENTION

This invention relates in general to hand tools, and relates in particular to a hand-held tool useful for sanding contoured surfaces such as vehicle bodies and for other purposes.

BACKGROUND OF THE INVENTION

Damaged body panels in automobiles and other motor vehicles typically are repaired by bending or hammering the metal to a shape which approximates the original contour of the body panel. A layer of body putty then is applied to the repaired surface of the panel, causing the putty to fill wrinkles and other minor imperfections in the exterior surface of the panel. After the body putty sets to a desired degree of hardness, the surface of the panel is restored to the original surface contour by removing body putty in excess of the surface contour. This putty removal, or at least the final finishing steps of removal, takes place by sanding the surface of the panel to remove high spots of putty and to provide a smooth overall surface finish. This sanded finish must blend with the surface on adjacent undamaged portions of the panel, and also must duplicate the original shape or contour of the panel, in order to provide a professional repaired surface that, after being painted, is visually indistinguishable from the original undamaged surface.

Body panels having only flat surfaces or rounded contours of relatively large radius, but lacking relatively sharp contours or curvilinear features, can be finished using power disk sanders or the like, as the repaired and original portions of the flat or large-radius curved surfaces are more readily blended together. However, relatively linear or elongated surface contours (as found, for example, on door panels) generally must be sanded by hand to blend the sanded finish with the original contour of the panel. This manual sanding usually requires a back-and-forth sanding movement paralleling the linear contour, and for the best result the manual sander or other repair tool should move in parallel alignment with the longitudinal extent of the body contour.

U.S. Pat. No. 5,050,308 discloses a contour sander maintained in linear alignment with a body panel by a tool guide while moving the contour sander back and forth to reproduce the desired contour in the panel. That apparatus is useful in many applications, particularly on relatively long panels such as vehicle doors or fenders allowing sufficient room to attach the tool guide with the suction cups provided for that purpose. However, there are instances where the contoured surface of the panel being repaired has a relatively short extent which will not easily accommodate the attachment of the tool guide, or where the worker doesn't believe a relatively small damaged area will justify the time spent in aligning and attaching the tool guide. In situations such as those, many body workers will instead turn to conventional hand-held devices for holding or supporting the sandpaper. If those devices do not support the sandpaper with a contour that closely matches the body contour being sanded, the resulting finished work is less likely to match the contour of the original undamaged panel.

Hand-held devices for supporting pieces of sandpaper are known in the art. However, those devices generally are useful only for finishing flat surfaces or contours of relatively large radius, and the art sanding devices are not widely accepted for finishing vehicle body repairs where a variety of body contours are encountered in different makes and models of vehicles.

SUMMARY OF THE INVENTION

Stated in general terms, the sander of the present invention includes a handle shaped for convenient holding by the hand, and an insert removably supported by the holder and having a profiled surface. This profiled surface is used for supporting a sandpaper sheet of predetermined size, in one disclosed embodiment of the invention. The holder defines an opening for receiving the insert and can selectively enlarge that opening for attaching or removing an insert without difficulty. Any number of different inserts thus are readily interchangeable in a single holder, with each insert having a different profiled surface conforming to certain selected profiles of various automotive body details or specifically adapted for other purposes.

Stated somewhat more specifically, the holder has an elongated slot for receiving and engaging a removable attachment member forming part of each insert. The holder is capable of selectively enlarging that slot, at least at one end thereof and preferably at both ends, to assist in inserting and removing the attachment member. In a preferred form of the invention, the attachment member of the insert comprises a spline configured to slide within the slot and having an outer head portion enlarged to retain the spline within the slot. With the slot selectively enlarged as described above, the spline readily slides through the slot to permit attaching the insert. However, upon returning the slot to its normal or unexpanded size, the holder snugly engages the insert to prevent relative movement between the insert and the holder while sanding takes place.

Stated in greater detail, the holder is elongated and generally U-shaped in cross section. The holder has one edge closed to form a handle of generally bulbous shape for manually grasping the holder, and the sides of the holder flare inwardly toward the opposite edge to receive the thumb tip and finger tips of a hand. The opposite edge of the holder has a pair of mutually confronting flanges separated to define a slot extending along that opposite edge. Between the sides of the holder is a cam which, when rotated, spreads the confronting flanges further apart and thereby widens the slot, making it easier to insert or withdrawn the spline of an insert. This cam is on an end member of the holder, and rotating that end member relatively to the holder causes the cam to widen the slot. In a preferred embodiment, separate end members are rotatably mounted at the opposite ends of the holder, and each end member includes a cam for spreading apart the slot at the corresponding end of the holder.

The holder and an appropriate insert are also useful for other purposes, one such application being as a squeegee for screen printing.

Accordingly, it is an object of the present invention to provide an improved hand-held tool.

It is another object of the present invention to provide an improved detail sander.

It is another object of the present invention to provide a detail sander readily adaptable to conform with any of various profiles to be sanded.

It is a further object of the present invention to provide a hand-held detail sander that is relatively inexpensive yet easily and readily adaptable to conform with the shape of various surfaces being finished.

Other objects and advantages of the present invention will become apparent from the following description of a preferred embodiment.

DETAILED DESCRIPTION OF PREFERRED EMBODIMENT

Figure 1:
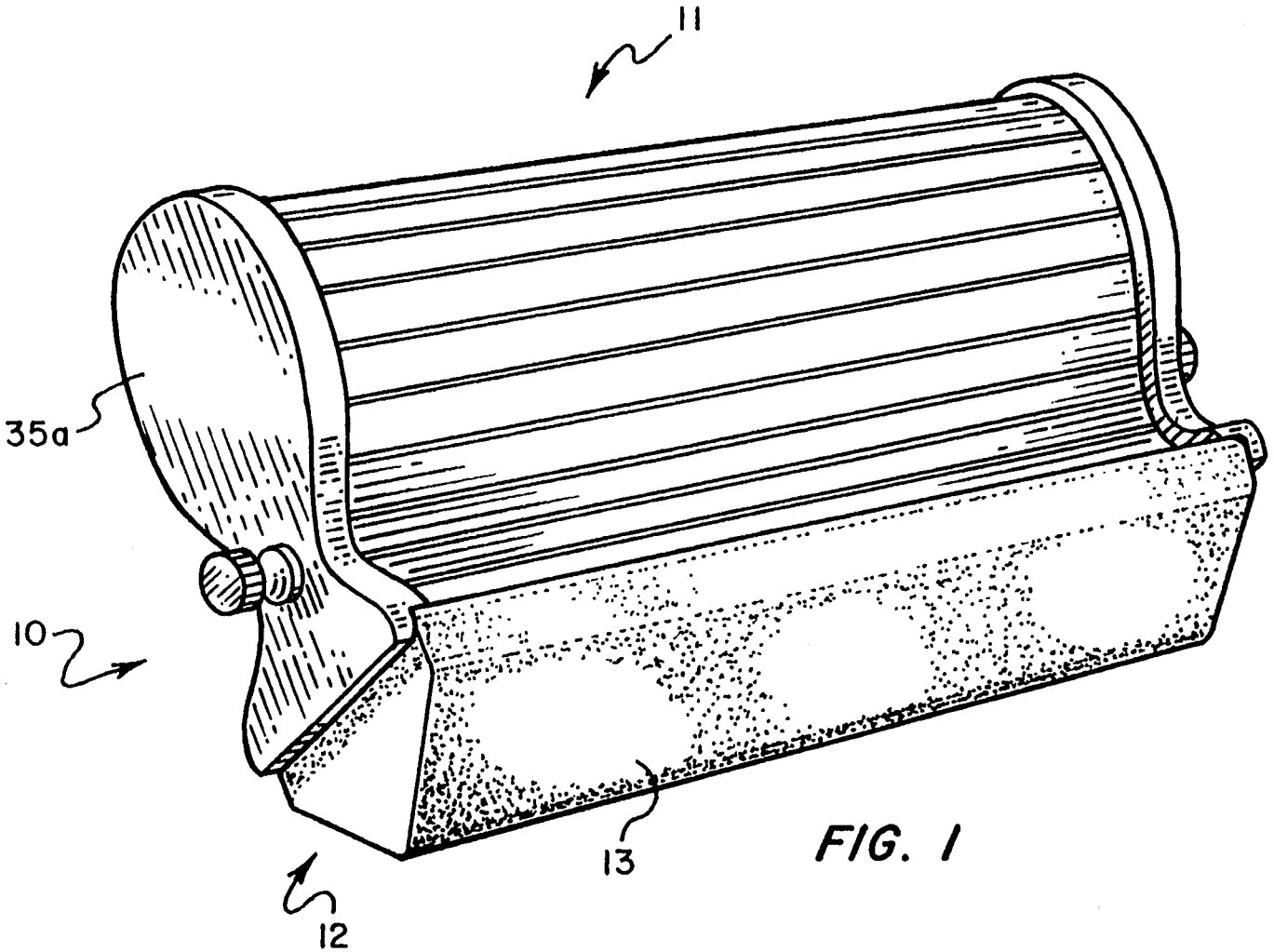
FIG. 1 is a pictorial view showing a detail sander according to a preferred embodiment of the present invention.
Figure 2:
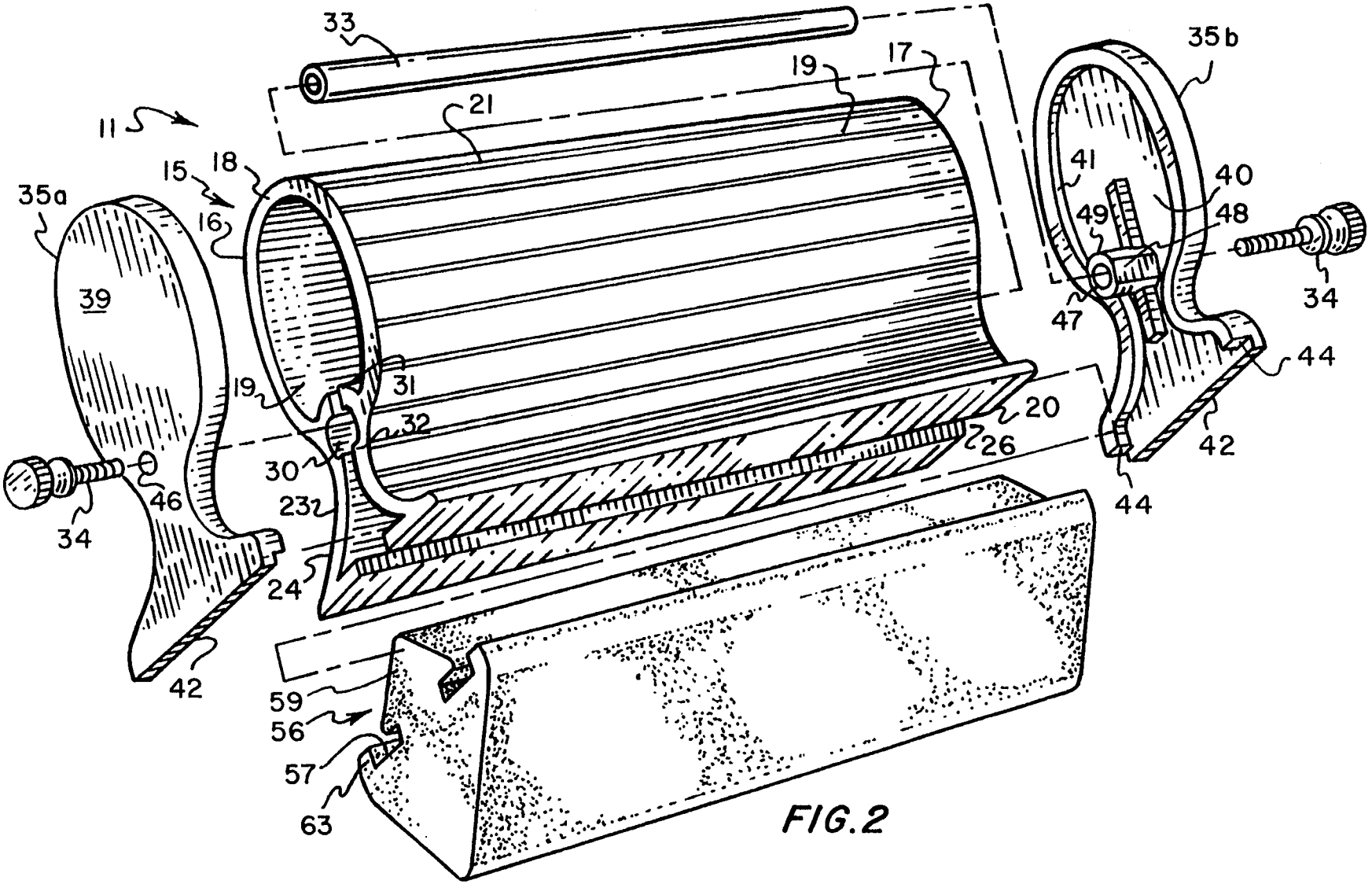
FIG. 2 is an exploded view of the sander shown in FIG. 1.
Figure 3A:
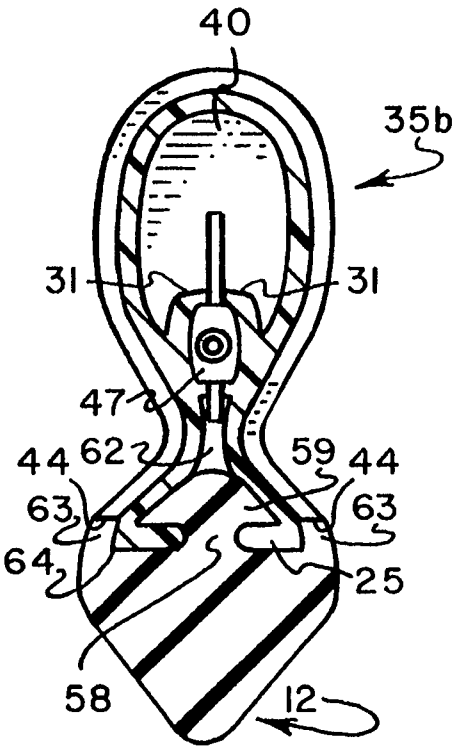
FIG. 3A is a section view taken along line 3A—3A of FIG. 3.
Figure 3:
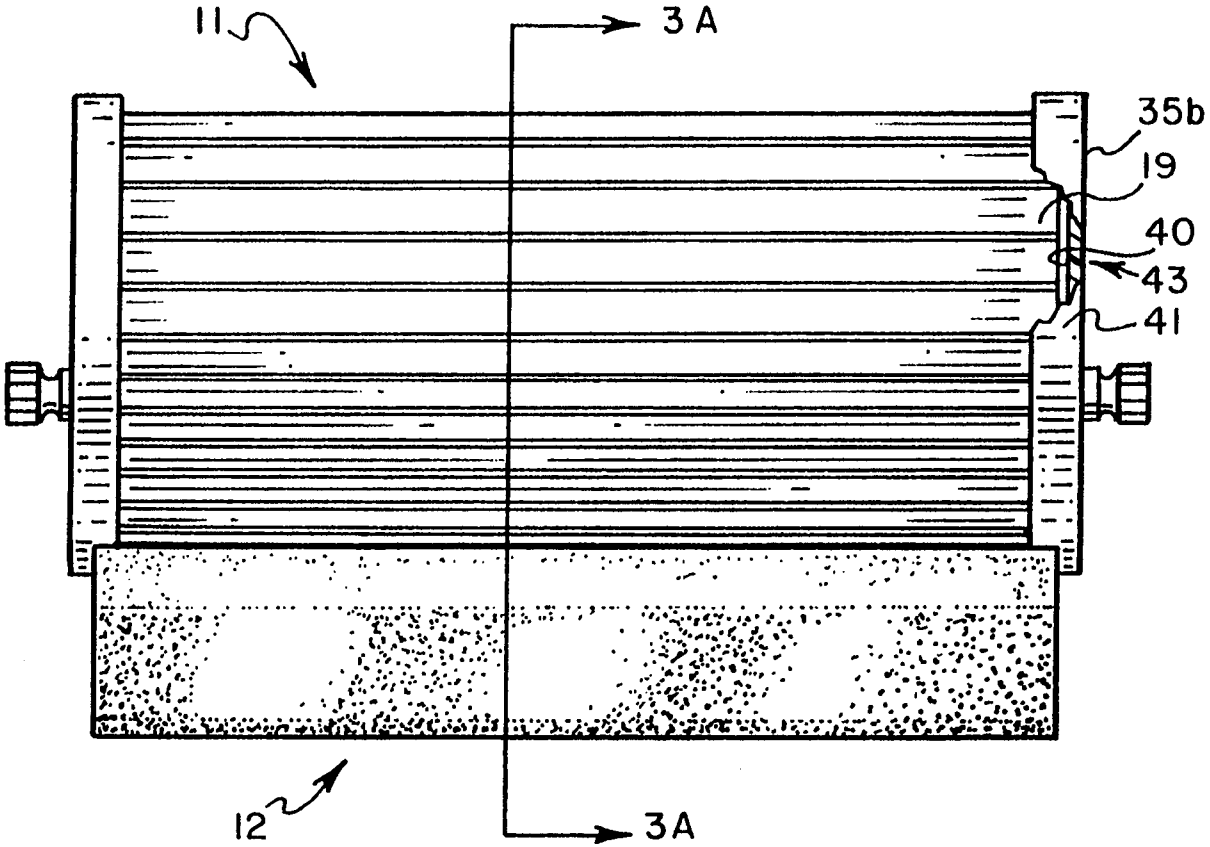
FIG. 3 is a side elevation view of the detail sander shown in FIG. 1.

FIGS. 1–3 show a detail sander 10 according to a preferred embodiment of the present invention. The detail sander 10 includes a holder 11 and a separate insert 12, each of which also are shown separated in FIG. 5. As will become apparent from the following description, the insert 12 is one of many such inserts interchangeably insertable into the holder 11 and having an exterior surface 13 to which a section of sandpaper may be attached by suitable means such as adhesive. The contours of the exterior surface 13 for the various inserts 12 are shaped for a complementary fit into the contours of particular shapes found in selected workpieces undergoing repair. The contoured body panels of automobiles, trucks, and other vehicles are examples of work surfaces for which the present detail sander is particularly useful, although other uses will suggest themselves to persons of ordinary skill.

Seen with greater detail in FIG. 2, the holder 11 of the preferred embodiment is an elongated unitary shell 15 preferably formed by extrusion molding of a suitable plastic material. The elongated holder shell 15 has open ends 16 and 17, and a closed rounded edge 18 extending the length of the holder. A pair of spaced-apart sides 19 extend laterally from the closed edge 18 toward the open opposite edge 20 of the holder 11. The sides 19 are formed as a smooth continuation of the rounded edge 18 and are relatively bulbous in external configuration near that edge but the sides are pinched inwardly toward each other as shown at 23 near the opposite open edge 20. The resulting cross-section shape of the holder is that of a modified U, and may be likened to the shape of a goldfish or tadpole. In use, the relatively bulbous shape near the closed edge 18 fits within the recess between the thumb and index finger of a user's hand, while the thumb and fingertips of that hand fit in the pinched regions 23 adjacent the opposite edge. Longitudinal ridges 21 are formed on the outside of the shell 15 to assist in gripping the sander 10.

The pinched region 23 of each side 19 flares outwardly at 24 toward the open edge 20. Mutually-parallel tinges 25 extend inwardly from the comers 64 at each outwardly-flared end 24, and the free ends of these flanges are spaced apart to define an open slot 26 extending the length of the holder 11.

An internal channel 30 extends from end to end within the shell 15 of the holder 11, as best seen in FIG. 2. This internal channel is located approximately midway between the closed edge 18 and the open edge 20. The internal channel is formed by the laterally separated flanges 31 and 32 formed on the inner surface of each side 19 making up the holder 11. The tinges 31, 32 on either side 19 confront their counterparts on the other side but need not contact their counterparts, so long as those flanges define the internal channel 30 to receive and locate an elongate post 33 slidably received within that channel.

The post 33 is internally threaded at each end to receive the screws 34 that extend through openings in the respective end members **35*a*, 35*b*, thereby supporting the end members to close the open ends 16 and 17 of the shell 15**.

Figure 5:
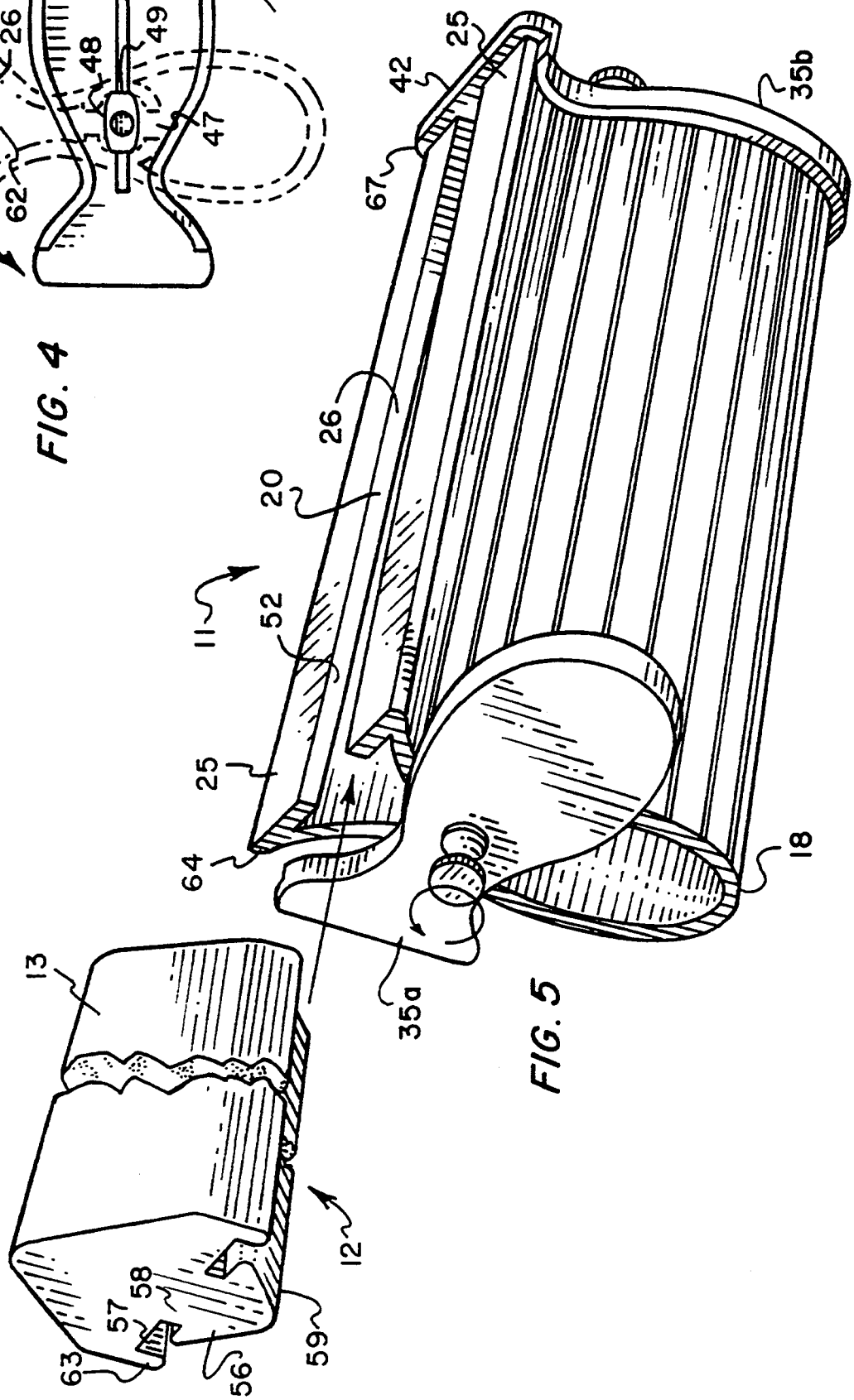
FIG. 5 is a pictorial view showing the present detail sander with the slot enlarged at one end and receiving an insert through that enlarged end.

The end members **35*a*, 35*b* have an overall "tadpole" shape corresponding to the cross-sectioned shape of the holder shell 15. The inner face 40 of each end member is sized to cover the open end 16, 17 of the shell 15, including the wall thickness of that shell. A rim 41 extends outwardly a short distance from the periphery of the inner face 40 and terminates at the two ends 44 just short of the tail end 42 of the end member, which confronts the ends of the slot 26 as best seen in FIGS. 2 and 5. The rim 41 thus surrounds that inner face, except for the tail end 42 of the end member. The rims 41 thus fit over the outside of the confronting ends 16, 17 of the holder shell 15 and enclose those ends, as shown at the cutaway region 43** in FIG. 3.

Figure 4:
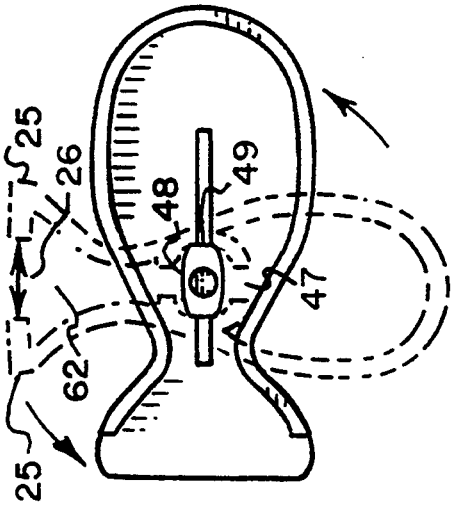
FIG. 4 is a partial section view also taken along line 3A—3A and showing the inside of the end member at one end of the detail sander, with the insert omitted and the body shell outlined in broken lines.

The end members **35*a*, 35*b* are secured to the holder by the screws 34, as previously mentioned. Each screw 34 loosely fits through an opening 46 extending through the outer face 39 of the end member, and that opening continues through a post 47 formed on the inner face 40 of the end member. Seen in FIGS. 2 and 4, and in the cross-section of FIG. 4, the exteriors of these posts 47 are eccentric with respect to the axis of rotation of the end member 35*a*, 35*b* around the corresponding screw 34, so that each post functions as a cam for a purpose described below. The posts 47 achieve this eccentric shape in the preferred embodiment by being generally rectangular in cross-section, with the corners joining the longer sides 48 to the shorter sides 49 being rounded as best seen in FIG. 4. The longer sides 48 are aligned with the longitudinal axis of each end member 35*a*, 35*b*, and the shorter sides 49** are perpendicular to the longer sides and thus extend laterally to the length of the end members.

The shorter sides 49 extend laterally between the inner faces of the flanges 31 and 32 defining the internal channel 30 through the holder shell 15 when the end members are aligned with that shell. That condition is shown in FIGS. 2 and 3A. However, rotating either end member 35*a* or 35*b* 90° to the position shown in FIG. 4 (and, in FIG. 5, by the end member 35*a*) transposes the former positions of the longer sides 48 and shorter sides 49, so that the shorter sides now engage the inner faces of the flanges 31 to spread apart the open edge 20 at the corresponding end of the holder in opposition to the natural resilience of the shell 15. As a result, the slot 26 at that end of the holder also becomes enlarged, as shown in FIG. 5 where the end member 35*a* is rotated to the position shown in that figure to spread apart the flanges 25 at the adjacent end of the shell 15, thereby enlarging the end 52 of the slot 26 relative to the other end of that slot. Each end member 35*a*, 35*b* is independently rotatable on the axis of the elongate rod 33, allowing selective enlargement of either end or both ends of the slot 26 by rotating either or both end members so that the eccentric surfaces of the corresponding posts 47 engage and spread apart the sides 19 of the holder.

The insert 12 has an exterior surface 13 for mounting a piece of sandpaper, and that exterior surface can be formed with any shape desired to sand a complementary contour in an automotive body or other workpiece. The insert 12 shown in the preferred embodiment, having an exterior surface 13 of generally V-shaped contour, thus is but one typical insert usable with the present detail sander. By designing the inserts 12 and the holder 11 so that the inserts are readily interchangeable within the holder, the worker can have at hand a variety of inserts for particular jobs and use those inserts with only a single holder. The inserts 12 in the preferred embodiment are extruded from an elastomer such as rubber of suitable hardness, and thus can be relatively inexpensive compared to the holder 11.

The inserts 12 are made interchangeable within the holder 11 by providing each insert with a spline 56 extending outwardly from the back surface 57 of the insert in a direction perpendicular to that surface. The spline 56 has a neck portion 58 whose proximal end adjoins the back surface 57, and whose distal end becomes the enlarged head 59 best seen in FIGS. 2, 3A, and 5. The width of the neck portion 58, as seen in cross-section in FIG. 3A, is selected relative to the width of the slot 26 in the holder 11 such that the neck portion is a snug engaging fit within that slot when both end members 35*a*, 35*b* are aligned with the transverse dimension of the holder shell 15 so as not to enlarge the ends of the slot.

Figure 6:
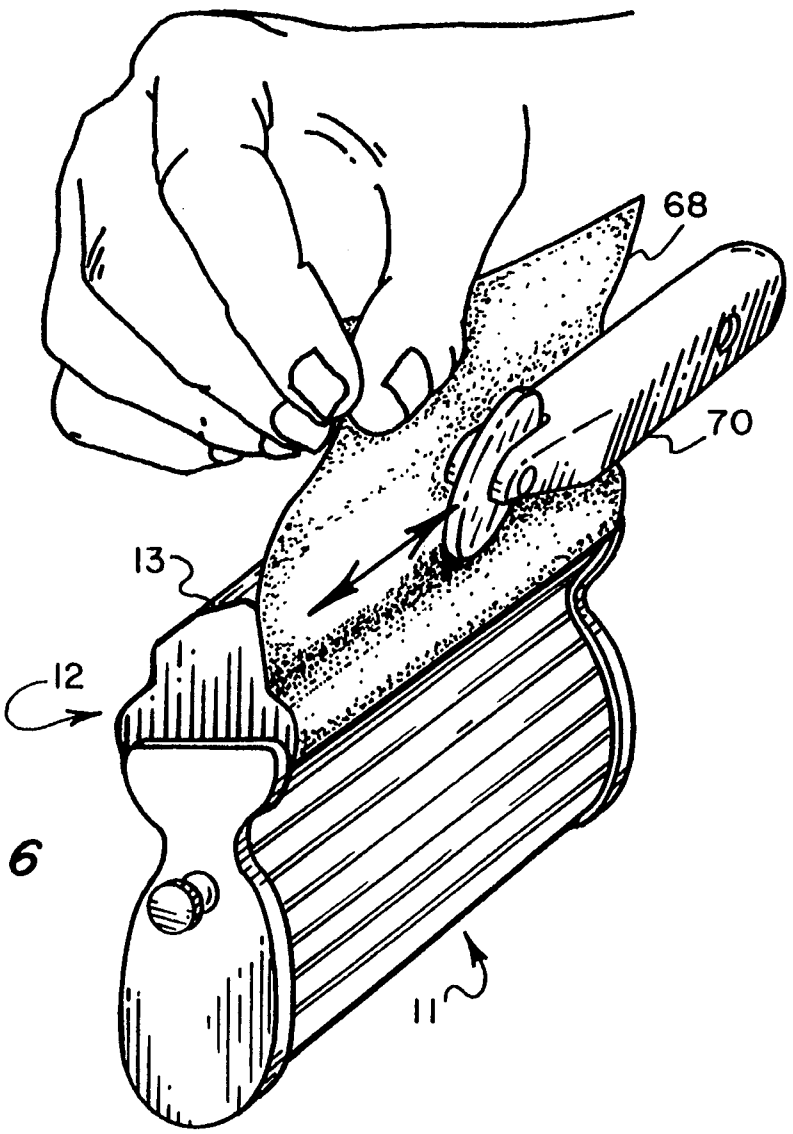
FIG. 6 is a pictorial view illustrating the step of attaching a piece of sandpaper to the profile of an insert according to the present invention.

The detail sander 10 as thus far described is operated in the following manner. A worker first selects a particular insert 12 having an exterior surface 13 with a desired configuration for the particular sanding job. This desired exterior surface may be symmetrical about the transverse axis of the insert as shown in FIG. 3A, or may be asymmetrical as shown in FIG. 6. Once the desired insert 12 is selected, the worker must now expand at least one end of the slot 26 (and preferably both ends) with the simple expedient of loosening the screw 34 of the end member at that end, pulling out the end member to free the rim 41 from the end 16, 17 of the shell 15, and then rotating by 90° the end member 35*a*, 35*b* adjacent that one end. This rotation causes the eccentric outer configuration of the post 47 associated with the selected end member to spread apart the sides 19 of the holder shell 15, as previously mentioned. If a different insert 12 is already in place within the holder, that insert is removed from the now-opened end of the slot 26 simply by exerting finger pressure at the opposite end of the existing insert to slide the insert through the slot. The newly-selected insert 12 then is placed in the holder by inserting one end of the spline 56 into the expanded end of the slot 26. The neck 58 of the spline comfortably fits into the slot 26 formed between the flanges 25 at the open edge 20 of the shell 15. The enlarged head 59 of the spline extends into the region 62 located above the flanges 25, as viewed in FIG. 3A, thereby captivating the spline within the holder 11 as the worker slides the insert 12 into the enlarged slot, a step best illustrated in FIG. 5.

Each outer edge of the back surface 57 terminates in a longitudinal ridge 63 extending outwardly from the back surface. These ridges are parallel with the neck portion 58 of the spline 56. The neck portion 58 and the two ridges 63 thus divide the back surface 57 into two longitudinal segments, the width of each segment being substantially the same as the width of each mating flange 25 that fit within those segments as shown in FIG. 3A. Each ridge 63 thus wraps around a lower comer 64 of the shell 15, where the flanges 25 join the outwardly-flared region 24 of the sides 19 adjacent the open edge 20 of the shell. This mating engagement of the flanges 25 with regions of the back surface 57, and the wraparound engagement of the ridges 63 with the comers 64 of the holder shell 15, provide a significant amount of lateral stability between the insert 12 and the holder 11. The insert thus undergoes little or no displacement relative to the holder as lateral force is applied to the holder during a sanding operation.

Once the insert 12 is fully in place within the slot 26, the end member(s) 35*a*, 35*b* are returned to the parallel position shown in FIG. 1 and each screw 34 is tightened to enclose the shell end 16, 17 within the rim 41 of the end member. That step allows the natural resilience of the shell 15 to contract the width of the slot end(s) so that the edges of the flanges 25 defining that slot move into relatively snug gripping engagement with the neck portion 58 of the spline 56. Moreover, the tail end 42 of each end member 35*a*, 35*b* is moved in position to block the ends of the slot 26, as best seen at 67 in FIG. 5. The tail end 42 of each end member thus positively retains the insert 12 within the slot 26 of the holder 11 while the end members are longitudinally aligned with the width of the shell 15. Furthermore, the ends 44 of the rim 41 on each end member lie alongside the outer surface of each ridge 63 on the inset 12 as seen in FIG. 3A and help stabilize the insert against lateral force.

With the appropriate insert 12 now mounted in the holder 11, the worker next attaches a suitable sheet of sandpaper 68 to the exterior surface 13 of the insert as illustrated in FIG. 6. Those skilled in the art will realize that the term "sandpaper" is used herein in an inclusive sense to comprise any kind of sheet material containing abrasives or having an outer surface which otherwise interacts with the surface of a workpiece against which the sandpaper is moved. Thus, the term "sandpaper"as used herein encompasses not only such materials normally used for repairing vehicles bodies, but is also intended to include abrasive and polishing materials of the kind used in woodworking or other applications. These sandpapers usually have an adhesive backing for attaching the paper to the exterior surface 13 of the insert 12, although other attachment expedients are known to those skilled in the art. If the exterior surface 13 has relatively sharp corners or abrupt angles as illustrated in FIG. 6, the worker may use a conventional hand roller 70 to press the sandpaper into contact with the exterior surface 13 along the entire expanse of that surface. Once the sandpaper 68 is affixed to the insert 12, the detail sander 10 can be used to sand the workpiece with the contour provided by the selected insert.

Figure 6A:
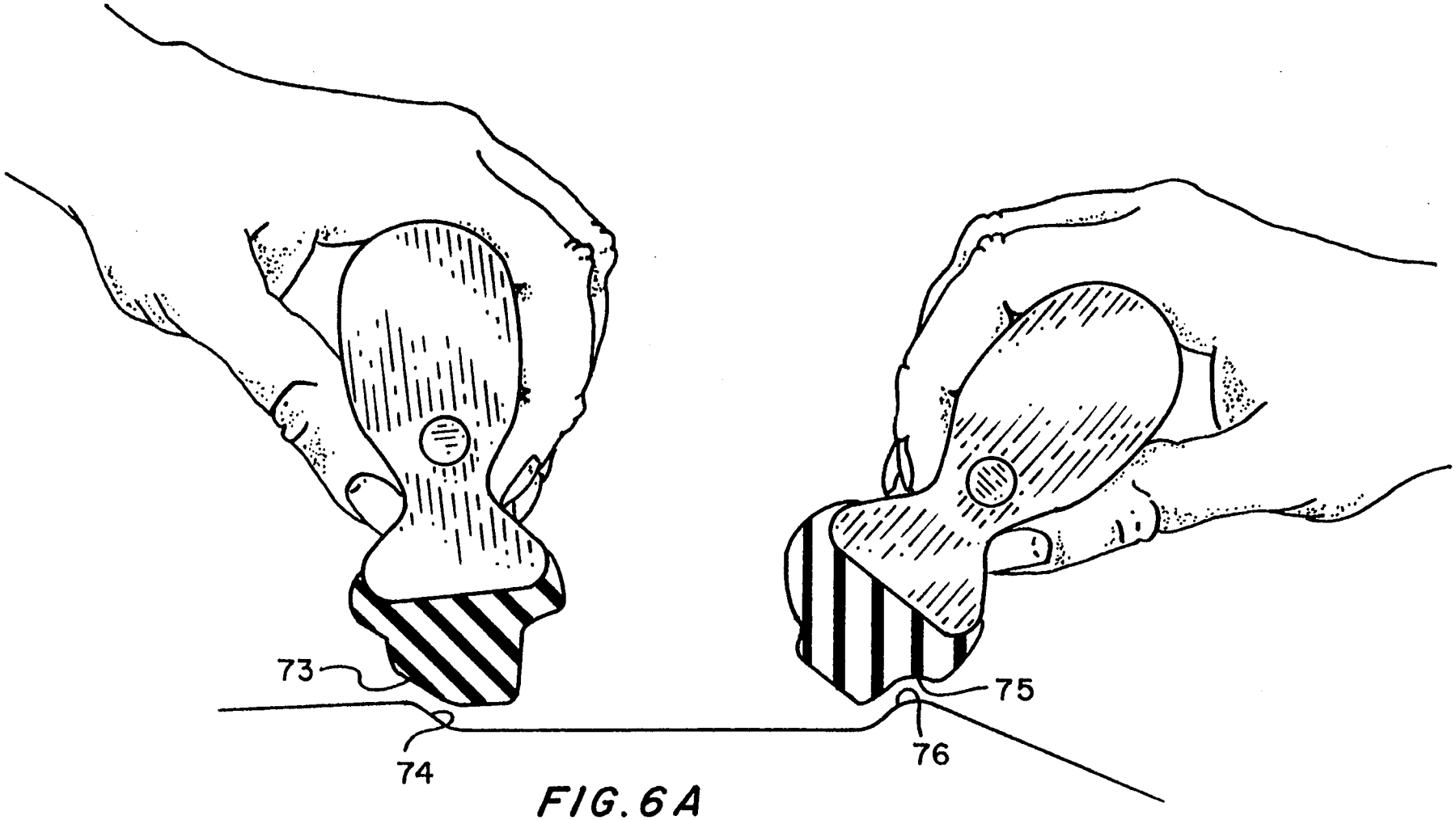
FIG. 6A is a pictorial view illustrating two applications of the detail sander.

FIG. 6A illustrates two typical uses of the detail sander as described. In the left part of that figure, the beveled surface 73 of a different insert is shown in use to sand the mating narrow flat surface 74 of a vehicle body. In the right part of the figure, the arcuate surface 75 of yet another insert is being used to sand the rounded edge of the body. Both inserts shown in FIG. 6A also have other contours on their exterior surfaces, and it should now be understood that a particular insert used with the detail sander can have plural surface contours configured for sanding selected different contours found on one or several designs of vehicle bodies.

Figure 9:
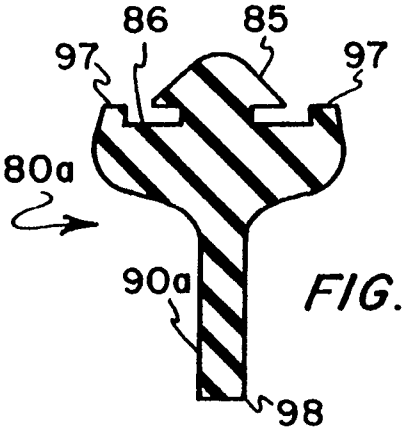
FIG. 9 is an end view of an alternate squeegee insert for use in the embodiment of FIG. 7.
Figure 8:
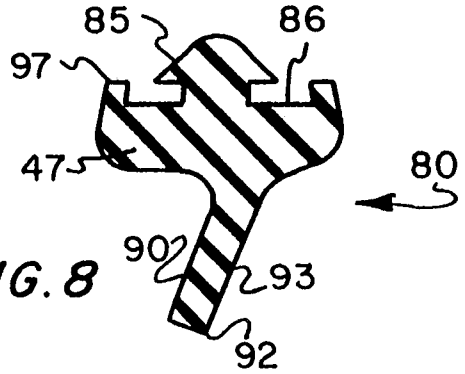
FIG. 8 is an end view of the squeegee insert shown in the embodiment of FIG. 7.
Figure 7:
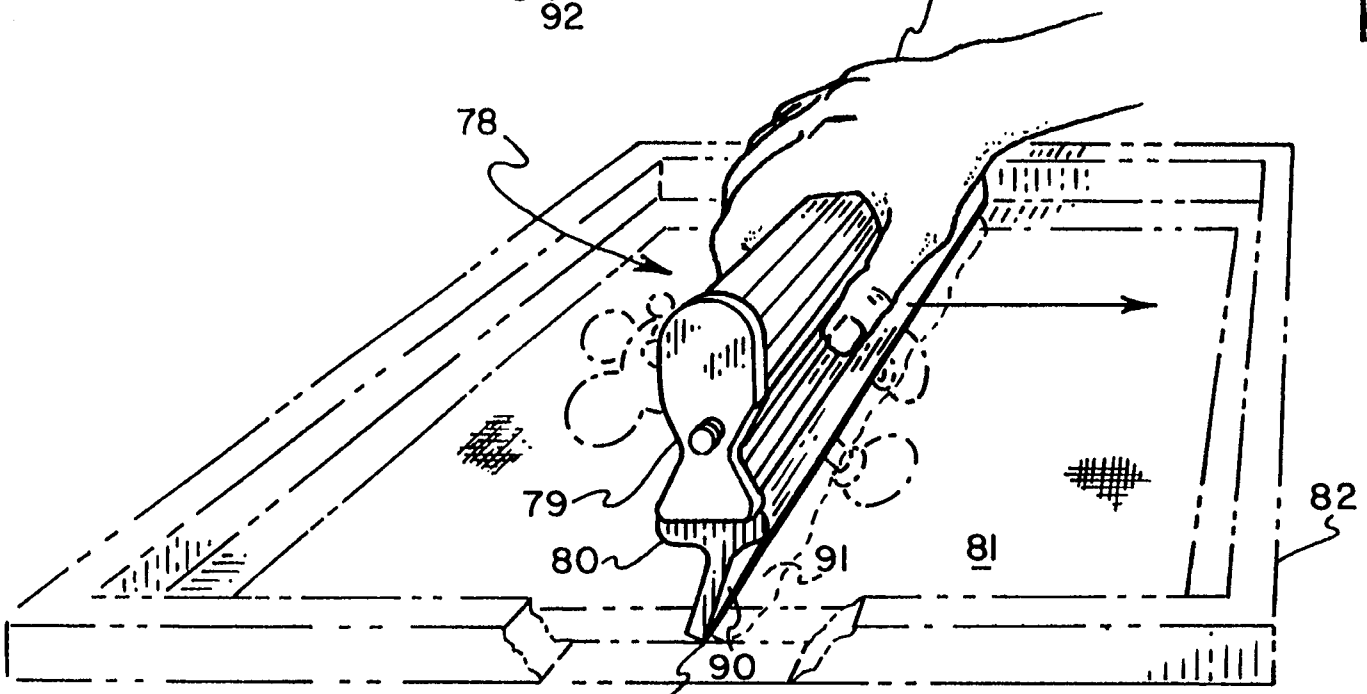
FIG. 7 is a pictorial view showing a screen-printing squeegee according to another preferred embodiment of the present invention.

FIGS. 7–9 show an alternative embodiment of the present invention adapted for use as a squeegee in screen printing applications. The squeegee assembly is shown at 78, and includes the squeegee holder 79 and a blade insert 80 mounted in the holder. The squeegee assembly 78 is depicted in FIG. 7 in use, with the squeegee being manually drawn across a printing screen 81 mounted in a conventional frame 82. Screen printing is well known to those skilled in the art and is not further discussed herein.

The holder 79 for typical screen printing applications may be longer than a holder 11 as described above for use as a detail sander, but the holder 79 is otherwise structurally and functionally identical to the earlier-described holder. Thus, it will be appreciated that the blade insert 80 is slidably received within the holder 79 and includes for that purpose a spline 85 extending upwardly from the back surface 86 of the blade insert. However, the squeegee blade 90 extending outwardly below the main body 87 of the blade insert 80 is different in structure and purpose from the sandpaper-receiving exterior surface 13 of the holder 11 previously described.

The squeegee blade 90 performs the function common to squeegees used in screen printing, that is, the blade spreads a uniform layer of the printing ink 91 across and through the printing screen 81 as the squeegee 78 is moved across the printing screen. To best accomplish that result, an outer edge 92 of the squeegee blade 90 must contact the screen 81 along a line of contact transverse to the movement of the squeegee 78 along the screen.

As best seen in FIG. 8, the required edge contact of the blade edge 92 is facilitated by manufacturing the blade insert 80 so that the squeegee blade 90 at rest is inclined or offset by an acute angle 93 relative to a line perpendicular to the back surface 86 of the insert 80. This angular offset of the squeegee blade 90 allows the blade edge 92 to make the desired line contact with the printing screen 81 while the holder 78 remains in an upright attitude with its lateral dimension being held substantially perpendicular to the printing screen.

FIG. 7 shows this application of the squeegee 78 including the angularly-offset squeegee blade 90. As the printer holds the squeegee 78, the hand and wrist 95 remains substantially straight (with the wrist not bent) because the holder 79 remains substantially perpendicular to the screen while the edge 92 of the inclined squeegee blade 90 engages the screen 91 with a desired line contact, due to the angular offset of the squeegee blade. The angle 93 is not considered critical to the present invention, although an angle of 17° is satisfactory for the intended purpose. The ability to maintain the wrist and forearm relatively straight while drawing the squeegee 78 across the printing screen reduces strain on the printer's wrists and should reduce the risk of carpal-tunnel syndrome arising from the bent-wrist position required for holding the conventional screen printing squeegee over prolonged times of usage.

Turning now to FIG. 9, an alterative embodiment of squeegee **80*a* is shown in that figure. The squeegee 80*a* has a squeegee blade 90*a* lacking the angular offset 93 of the blade 90, but otherwise structurally the same as the blade insert 80. It will thus be understood that when substituting the insert 80*a* for the insert 80 in the squeegee 78, the printer must grasp the holder 79 at an acute angle to the printing screen 81 so that the edge 98 of the squeegee blade 90*a* makes a line contact with the printing screen. Either squeegee embodiment is interchangeable in the holder 79**. Furthermore, squeegees of either embodiment but having different characteristics, such as hardness of the roller comprising the squeegee blade, are interchangeable in the holder.

The blade inserts 80 and **80*a* each have the two ridges 97 extending outwardly from the back surface 86 of the blade insert. These ridges 97 are similar to the ridges 63 described above with regard to the detail sander embodiment, and these ridges wrap around a lower comer of the holder 79 as seen in FIG. 7. These ridges 97 thus prevent or greatly inhibit the printing ink from flowing into the region between the back surface 86 of the blade insert and the confronting flange of the holder 79, a common problem with printing squeegees of the prior art. The ink that infiltrates between the blade and handle of conventional squeegees can later migrate out from that area when ink of a different color is in use, thereby adulterating that different color and spoiling the products being printed. The present squeegee blade inserts 80 and 80*a*, including the ridges 97** that significantly wrap around the lower corner of the squeegee holder, thus prevent or significantly alleviate that problem.

The present squeegee has the added advantage of being easier to clean. Screen printers often apply tape along the sides of prior-art squeegees to prevent the printing ink from running up onto the handle, and also to prevent the ink from infiltrating between the blade and handle as mentioned above. This tape must be removed and reapplied each time a different blade insert is attached to the handle. However, the above-mentioned interaction between the ridges 97 and the lower edge of the squeegee holder prevents ink from reaching the holder 79, so that taping the insert and holder is not necessary. The blade 90 or **90*a*** simply is wiped clean before removing the blade insert from the holder.

As mentioned above, squeegees intended for screen printing may be relatively long and a typical length for such squeegees is 33 inches. Squeegees of much greater length are used for certain printing applications. With squeegees of those lengths made according to the present invention, the resilience of the shell 15 may prevent the midpoint of the slot 26 from becoming sufficiently expanded for easy removal or placement of a blade insert 80 even when both end members rotated to enlarge the ends of the slot. That problem can be overcome by adding at least one cam member, functionally similar to the posts 47 on the end members **35*a*, 35*b*, affixed to the rod 33 extending through the holder. This cam is intermediate the ends of the rod and confronts the flanges 31 of the internal channel 30 in the shell 15. The rod in this modification is keyed or otherwise affixed to at least one end member of the holder, so that the rod also rotates as the end member is turned to enlarge the adjacent end of the slot. This rotation of the rod and the cam affixed to that rod also enlarges an intermediate portion of the slot as the cam engages the flanges 31 within the shell and spreads apart the flanges 35** defining that slot, so that a blade insert easily slides through the expanded slot.

It should be understood that the foregoing relates only to preferred embodiments of the present invention and that numerous modifications rand changes therein may be made without departing from the spirit and scope of the invention as defined in the following claims.

What is claimed is:

1. Hand-held apparatus for supporting a surface treating element in operative relation to a workpiece, comprising:

a holder defining a surface having an opening for receiving an insert;

an insert having a profiled surface of predetermined size, and further having an attachment member configured to fit in the opening in snug engagement with the holder so that the insert is removably attached to the holder with no relative movement therebetween that might otherwise interfere with a sanding operation;

the insert having a back surface configured for close confronting relation with the surface of the holder when the insert is attached to the holder;

a pair of ridges extending outwardly from the back surface of the insert to engage and extend around opposite sides of the confronting holder surface so as to resist lateral movement of the insert relative to the holder during a sanding operation; and means associated with the holder and selectively operative to enlarge the opening sufficiently to loosen the snug fit with the insert, whereby the attachment member can easily be removed from or installed in the opening.

2. Apparatus as in claim 1, wherein:

the opening defined in the holder comprises an elongated slot; and the attachment member comprises a spline that snugly fits in the slot.

3. Apparatus as in claim 2, wherein:

the spline slidably fits in the slot; and the means comprises a cam operative to enlarge the slot, thereby relieving the snug fit so as to permit ease of removing or installing the spline.

4. Hand-held apparatus for supporting a surface treating element in operative relation to a workpiece, the apparatus comprising:

a holder defining an opening for receiving an insert; an insert having a profiled surface of predetermined size, and further having an attachment member configured to fit in the opening in snug engagement with the holder so that the insert is removably attached to the holder with no relative movement therebetween that might otherwise interfere with a sanding operation;

means associated with the holder and selectively operative to enlarge the opening sufficiently to loosen the snug fit with the insert, whereby the attachment member can easily be removed from or installed in the opening;

the holder having an elongate dimension and including a handle substantially coextensive with the elongate dimension;

the opening comprising an elongated slot extending substantially coextensive with the handle, whereby the handle and the profiled surface of an insert received in the handle are mutually coextensive along the length of the holder, so that the holder and the insert are centered relative to the hand of a person holding the handle in surface treating relation to a workpiece; and the means comprising a cam selectively operative to enlarge at least part of the slot, thereby enabling the insert to move into or out of the open end of the enlarged slot.

5. Apparatus as in claim 4, wherein:

the slot is open at an end thereof;

the insert is made of an elastomer and has an elongate spline configured to fit through the slot and retain the insert in selectively fixed relation with the holder; and the means comprises a cam selectively operative to enlarge at least part of the slot, thereby enabling the spline to move into or out of the open end of the enlarged slot.

6. Apparatus as in claim 1, wherein:

the holder has handle means extending in lateral relation to a longitudinal dimension of the holder;

the profiled surface of the insert comprises a squeegee blade for screen printing; and the squeegee blade having a blade member laterally extending from the attachment member at an acute angle to the lateral extent of the handle means, and having a longitudinal edge at a distal portion of the blade member, whereby the longitudinal edge of the blade can make a line contact with a printing screen when the blade is pressed against the printing screen with the handle means held substantially perpendicular to the screen.

7. Hand-held sanding apparatus comprising:

a holder, and a sandpaper supporting member removably inserted in tile holder;

the holder being elongate and generally U-shape in cross-section so as to have two opposed edges, with one edge closed to form a handle for manual holding and with two sides extending laterally from the one edge;

the sides defining at the opposite edge of the holder a pair of mutually confronting flanges separated to define a slot extending along the opposite edge;

the supporting member having a spline configured to removably fit in the slot so as to attach the supporting member to the holder;

the sandpaper supporting member having a back surface fitting in closely confronting relation to the flanges of the holder wherein the supporting member is inserted;

a pair of longitudinal ridges extending outwardly from opposite sides of the back surface to engage and extend around confronting sides of the flanges so as toresist lateral movement of the supporting member, relative to the holder, during a sanding operation; and means associated with the holder to selectively move the confronting flanges further apart, thereby widening the slot so that the spline is relatively easily inserted in or removed from the slot.

8. Hand-held sanding apparatus comprising:

a holder, and a sandpaper supporting member removably inserted in the holder;

the holder being elongate and generally U-shape in cross-section so as to have two opposed edges, with one edge closed to form a handle for manual holding and with two sides extending laterally from the one edge:

the sides defining at the opposite edge of the holder a pair of mutually confronting flanges separated to define a slot extending along the opposite edge;

the supporting member having a spline configured to removably fit in the slot so as to attach the supporting member to the holder;

means associated with the holder to selectively move the confronting flanges further apart, thereby widening the slot so that the spline is relatively easily inserted in or removed from the slot;

the means comprising a cam disposed between the sides of the holder and selectively operative to spread apart the confronting flanges; and the sides resiliently return to an unspread configuration when the cam is inoperative, whereby the spline is snugly retained in the slot.

9. Hand-held sanding apparatus comprising:

a holder, and a sandpaper supporting member removably inserted in the holder;

the holder being elongate and generally U-shape in cross-section so as to have two opposed edges, with one edge closed to form a handle for manual holding and with two sides extending laterally from the one edge;

the sides defining at the opposite edge of the holder a pair of mutually confronting flanges separated to define a slot extending along the opposite edge and open at least at one end;

the supporting member having a spline configured to removably fit in the slot by sliding into or out of the slot from the open end so as to attach the supporting member to the holder; and means associated with the holder to selectively spread apart the confronting flanges at the one end, thereby enlarging the slot at that end so that the spline is relatively easily inserted in or removed from the slot.

10. Hand-held sanding apparatus comprising:

a holder, and a sandpaper supporting member removably inserted in the holder;

the holder being elongate and generally U-shape in cross-section so as to have two opposed edges, with one edge closed to form a handle for manual holding and with two sides extending laterally from the one edge;

the closed edge and the sides of the holder defining a shell having an open interior and open ends;

the sides defining at the opposite edge of the holder a pair of mutually confronting flanges separated to define a slot extending along the opposite edge and having ends open at opposite ends of the shell;

end member located at each end of the shell;

the supporting member having a spline configured to removably fit in the slot so as to attach the supporting member to the holder; and means associated with an end member to selectively move the confronting flanges further apart, thereby widening the slot so that the spline is relatively easily inserted in or removed from the slot.

11. Apparatus as in claim 10, wherein:

the one end member associated with the means is movable with respect to the shell so as to operatively associate the means with the end members adjacent the one end of the shell, thereby widening the slot.

12. Apparatus as in claim 10, wherein:

the one end member associated with the means is mounted for rotation relative to the shell; and the means comprises a cam associated with the one end member for engaging the shell and moving apart the confronting flanges in response to rotation of the one end member.

13. Apparatus as in claim 12, wherein:

the one end member has an inner side facing an open end of the shell;

the cam is on the inner side of the one end member; and the cam engages and moves apart the sides of the holder in response to rotation of the end member, whereby the confronting flanges are moved apart.

14. Apparatus as in claim 10, further comprising:

an end member mounted at each end of the shell for selective rotation relative to the shell; and the means to move the flanges comprises means associated with each end member for moving apart the sides of the holder at the adjacent end of the shell and thereby moving apart the confronting flanges at the edges of the sides, in response to rotation of the corresponding member.

15. Apparatus as in claim 14, wherein:

the means associated with each end member comprises a cam operative to engage and move apart the sides of the holder in response to rotation of the end member.

16. Apparatus as in claim 14, further comprising:

elongate means extending within the shell; and each end member being supported by elongate means for rotation coaxially with the elongate means.

17. Apparatus as in claim 16, wherein:

the means associated with each end member comprises a cam disposed on the end member between the sides of the holder and operative to move apart the sides of the holder in response to rotation of the end member, whereby either end or both ends of the slot can be widened by rotating the end member at the corresponding end of the shell.

18. Apparatus as in claim 14, wherein:

the end members block the open ends of the slot when the end members are rotated to a position whereat the slot is not widened, so that the end members block the supporting member from sliding out of the slot.

19. Apparatus as in claim 7, wherein:

the sandpaper supporting member has a surface profiled to fit the contour of selected workpiece to be sanded, the profiled surface being adapted to receive sandpaper;

the spline is parallel to the profiled surface and extends outwardly from a back surface of the supporting member;

the spline has a neck extending outwardly from the back surface to fit through the slot in sliding relation therewith; and the spline further has an enlarged head at an outer end of the neck, the enlarged head being slidably retained behind the spline so as to retain the supporting member in the holder.

20. Hand-held sanding apparatus comprising:

a holder removably retaining a sandpaper supporting member having a spline;

the holder being elongate and generally U-shape in cross-section so as to have two opposed edges, with one edge closed to form a handle for manual holding and with two sides extending laterally from the one edge;

the sides defining at the opposite edge of the holder a pair of mutually confronting flanges separated to define a slot extending along the opposite edge and configured so that the spline of a sandpaper supporting member slidably fits within the slot to attach the supporting member to the holder;

the sandpaper supporting member having a back surface configured for close confronting relation with the flanges of the holder when the supporting member is attach to the holder;

a pair of longitudinal ridges extending outwardly from opposite sides of the back surface to engage and extend around confronting sides of the flanges, so as to resist lateral movement of the supporting member relative to the holder during a sanding operation: and means associated with the holder to selectively move the confronting flanges further apart, thereby widening the slot so that the spline is relatively easily inserted in or removed from the slot.

21. A sandpaper supporting member for use with the sanding apparatus of claim 20, wherein:

the sandpaper supporting member has a surface profiled to fit the contour of selected workpiece to be sanded, the profiled surface being adapted to receive sandpaper;

the spline is parallel to the profiled surface and extends outwardly from a back surface of the supporting member;

the spline has a neck extending outwardly from the back surface to fit through the slot in sliding relation therewith; and the spline further has an enlarged head at an outer end of the neck, the enlarged head being slidably retained behind the spline so as to retain the supporting member in the holder.

* * * * *